US006390031B1

(12) United States Patent
Suzuki et al.

(10) Patent No.: US 6,390,031 B1
(45) Date of Patent: May 21, 2002

(54) COOLING APPARATUS FOR LIQUID-COOLED INTERNAL COMBUSTION ENGINE

(75) Inventors: Kazutaka Suzuki, Kariya; Eizou Takahashi, Chiryu, both of (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 09/489,787

(22) Filed: Jan. 24, 2000

(51) Int. Cl.[7] ..... F01P 7/14
(52) U.S. Cl. ..... 123/41.1; 123/41.44
(58) Field of Search ..... 123/41.1, 41.44, 123/41.12

(56) References Cited

U.S. PATENT DOCUMENTS 4,545,333 A * 10/1985 Nagumo et al. ..... 123/41.02
5,390,632 A * 2/1995 Ikebe et al. ..... 123/41.02
6,101,987 A * 8/2000 Saur et al. ..... 123/41.1
6,109,219 A * 8/2000 Sano ..... 123/41.1

* cited by examiner

*Primary Examiner*—Tony M. Argenbright
*Assistant Examiner*—Katrina B. Harris
(74) *Attorney, Agent, or Firm*—Harness, Dickey & Pierce, PLC

(57) ABSTRACT

A flow rate ratio of a radiator flow rate to a bypass flow rate is determined from pump water temperature, bypass water temperature and radiator water temperature. The relation between the flow rate ratio and a valve opening degree of a flow control valve is predetermined as a map. The valve opening degree is determined from the flow rate ratio and the map. Accordingly, the cooling water temperature at an inlet of a pump is accurately controlled without detecting the flow rate of the cooling water.

10 Claims, 7 Drawing Sheets

FIG. 5

| PUMP | | CHANGING AMOUNT OF V.O.D. | | | | | | |
|---|---|---|---|---|---|---|---|---|
| | | +χ% · · · · CURRENT POSITION · · · · −χ% | | | | | | |
| DUTY | 10 | 3 | 2 | 1 | 0 | −1 | −2 | −3 |
| | 20 | 4 | | | | | | |
| | ⋮ | | | | | | | |
| | 90 | 6 | | | | | | |
| | 100 | 6.2 | | | | | | |

FIG. 6

| BLOWER | | CHANGING AMOUNT OF V.O.D. | | | | | | |
|---|---|---|---|---|---|---|---|---|
| | | +χ% · · · · CURRENT POSITION · · · · −χ% | | | | | | |
| DUTY | 10 | 3 | 2 | 1 | 0 | −1 | −2 | −3 |
| | 20 | 4 | | | | | | |
| | ⋮ | | | | | | | |
| | 90 | 6 | | | | | | |
| | 100 | 6.2 | | | | | | |

COOLING APPARATUS FOR LIQUID-COOLED INTERNAL COMBUSTION ENGINE

CROSS-REFERENCE TO RELATED APPLICATION

This application relates to Japanese Patent Application No. Hei. 10-214493 filed Jul. 29, 1998, the entire contents of which are incorporated herein by reference.

BACKGROUND OF THE INVENTION

1. Field of the Invention

The present invention relates to a cooling apparatus for a liquid-cooled internal combustion engine, such as a water-cooled engine, and it is preferably applicable to an internal combustion engine of a vehicle.

2. Description of Related Art

It is necessary to keep the engine cooling water temperature appropriate in order to drive the engine efficiently.

One type of known cooling apparatus for an engine is disclosed in JP-A-63-268912. The cooling apparatus disclosed in JP-A-63-268912 controls the engine cooling water temperature based on a wall surface temperature of the cylinder block of the engine.

In order to appropriately control the engine cooling water temperature at a cooling water inlet of an engine, the inventors of the present invention tried to develop a cooling apparatus having a flow control valve, at a connection between a radiator outlet side and a bypass passage which bypasses the radiator, which controls a flow rate of a radiator and a flow rate of the bypass passage. Further, the inventors tried to feedback control the valve opening degree of the flow control valve based on the cooling water temperature at a cooling water inlet side of the engine (cooling water inlet side of a pump). However, it was difficult to accurately control the cooling water temperature at the cooling water inlet side of the engine (hereinafter referred to as "the inlet temperature") because of the following reason.

The inlet temperature is determined based on the temperature and the flow rate of the cooling water flowing out from the radiator and the temperature and the flow rate of the cooling water flowing out from the bypass passage. On the other hand, the inventors' experimental model controls the valve opening degree based on only the temperature, regardless of the flow rate.

Accordingly, the change of the flow rate caused by the change of the valve opening amount is not reflected to the control of the flow control valve, and the control accuracy of the inlet temperature is compromised.

To solve this problem, it is possible to detect the flow rates of the cooling water flowing out from the radiator and the cooling water passed through the bypass passage, and to add the detected flow rates to the control parameters. However, it is practically difficult to place a flow rate detector, sensor and the line in the engine room because of the mounting space and the cost thereof.

SUMMARY OF THE INVENTION

The present invention is made in light of the above-mentioned problem, and it is an object of the present invention to provide a cooling apparatus which improves the control accuracy of the inlet temperature without detecting the flow rate of the cooling water.

According to a cooling apparatus of the present invention, an opening degree of a flow control; valve is controlled based on a first temperature (Tp) of the coolant discharged from an outlet of the flow control valve, a second temperature (Tb) of the coolant flowing through a bypass passage, and a third temperature (Tr) of the coolant flowing out from a radiator.

Accordingly, the cooling water temperature at the inlet of the engine is accurately controlled since the flow control valve is controlled by parameters including the flow rate without detecting the flow rate of the cooling water.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

FIG. 5 is a control map for the pump according to the embodiment of the present invention;

FIG. 6 is a control map for a blower according to the embodiment of the present invention;

DETAILED DESCRIPTION OF PREFERRED EMBODIMENT

A cooling apparatus for a liquid-cooled internal combustion engine of the present invention applied to a water-cooled engine of a vehicle is shown in FIGS. 1 to 8 as an embodiment of the present invention.

Figure 1:
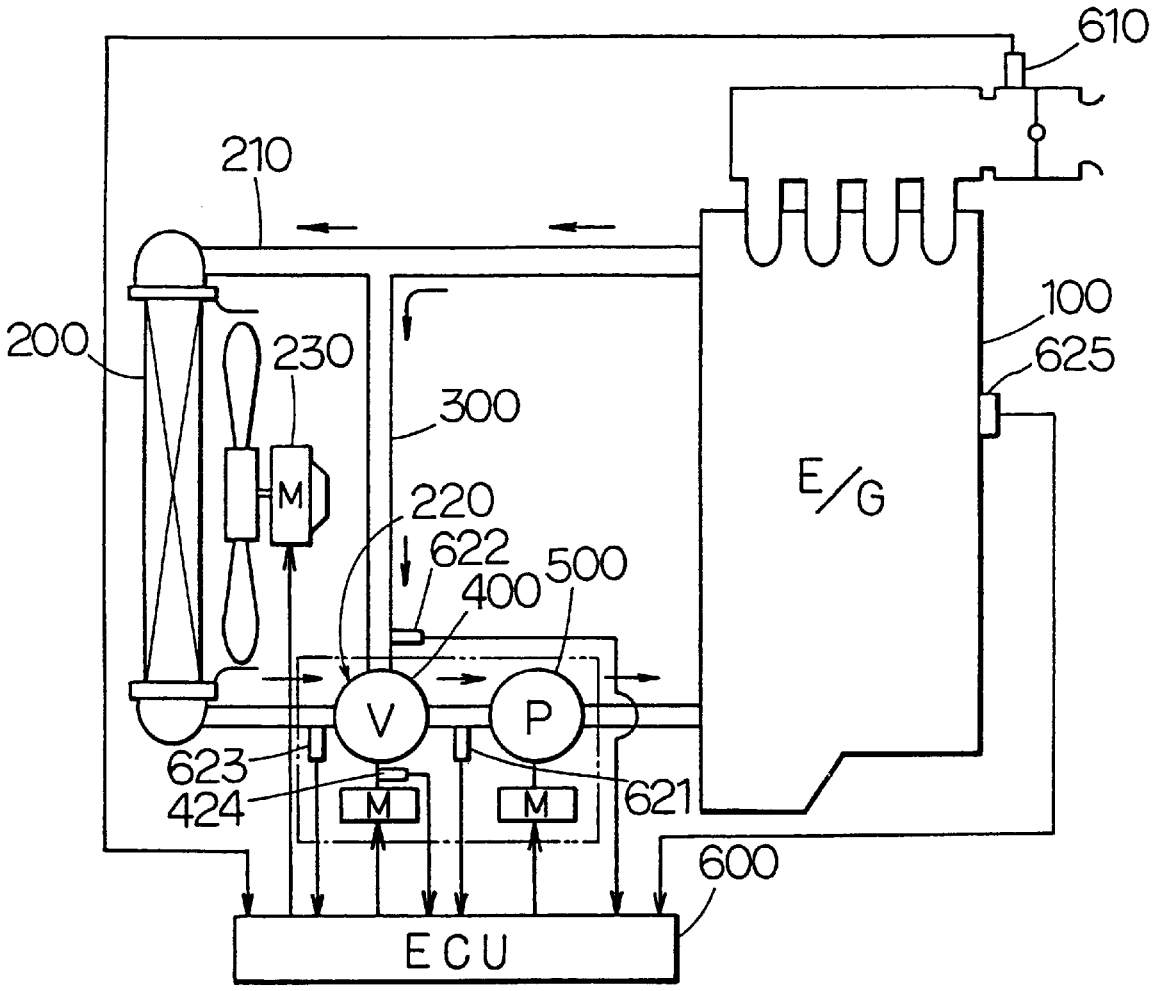
FIG. 1 is a schematic illustration showing a cooling apparatus for a liquid-cooled internal combustion engine according to a preferred embodiment of the present invention.

In FIG. 1, a radiator 200 cools cooling water (coolant) which circulates in the water-cooled engine 100. The cooling water circulates through the radiator 200 via a radiator passage 210.

A part of the cooling water flowing out from the engine 100 can be introduced to an outlet side of the radiator 200 at the radiator passage 210 by bypassing the radiator 200 via a bypass passage 300.

A rotary-type flow control valve 400 is provided at a junction 220 between the bypass passage 300 and the radiator passage 210 to control the flow rate of the cooling water passing through the radiator passage 210 (hereinafter referred to as "the radiator flow rate Vr") and the flow rate of the cooling water passing through the bypass passage 300 (hereinafter referred to as "the bypass flow rate Vb").

An electric pump 500 for circulating the cooling water which is operated independently from the engine 100 is provided at a downstream side of the flow control valve 400 in respect of the water flow direction.

Figure 2B:
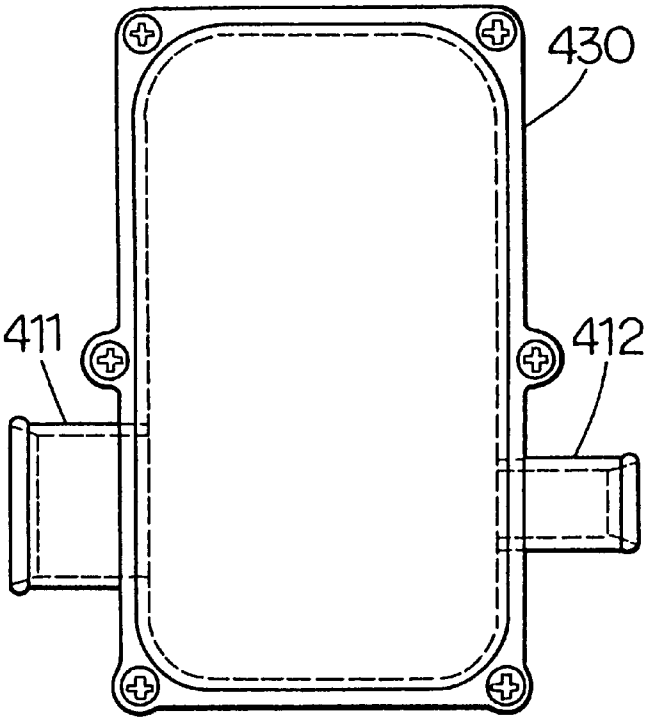
FIG. 2B is a plan view showing the integration of the flow control valve and the pump according to the embodiment of the present invention.
Figure 2A:
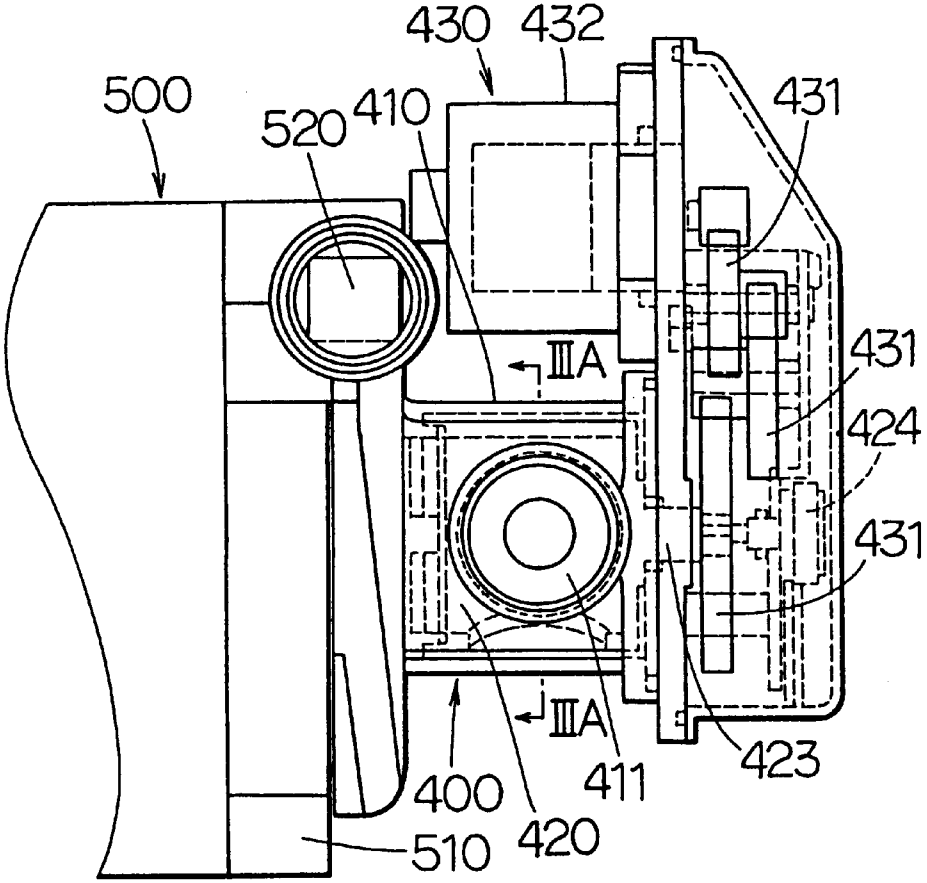
FIG. 2A is a perspective side view showing an integration of a flow control valve and a pump according to the embodiment of the present invention.

As shown in FIGS. 2A and 2B, the flow control valve 400 and the pump 500 are integrated together via a pump housing 510 and a valve housing 410. The valve housing 410 and the pump housing 510 are made of resin.

As shown in FIGS. 2A to 3B, a cylindrically-shaped rotary valve 420 having an opening at one end thereof (shaped like a cup) is rotatably housed in the valve housing 410. The valve 420 is rotated around its rotary shaft by an actuator 430 having a servo motor 432 and a speed reducing mechanism comprising several gears 431.

Figure 3A:
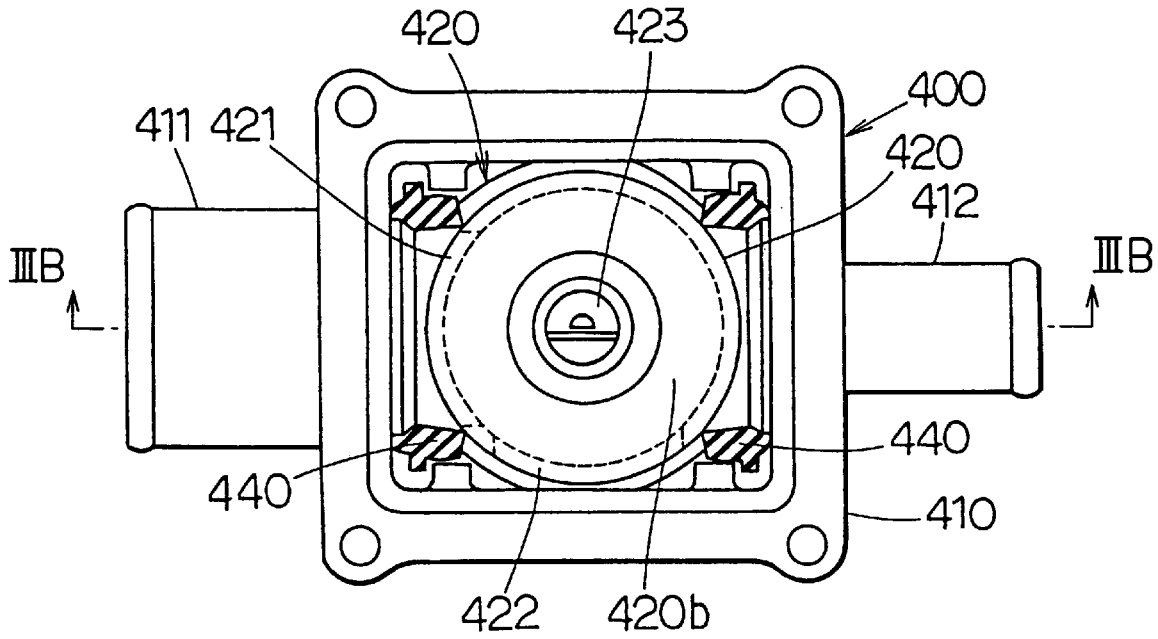
FIG. 3A is a partially sectional view taken on the line IIIA—IIIA in FIG. 2A according to the embodiment of the present invention.
Figure 3B:
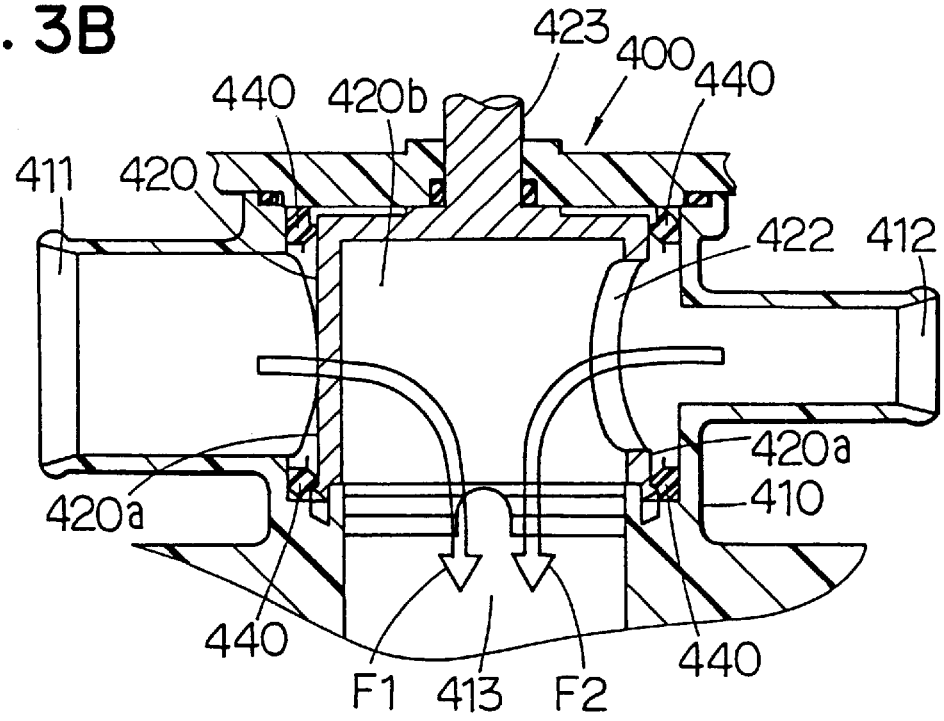
FIG. 3B is a part of a sectional view taken on the line IIIB—IIIB in FIG. 3A according to the embodiment of the present invention.

As shown in FIG. 3A, a first valve port 421 and a second valve port 422, having the identical diameter to each other to communicate the inside with the outside of a cylindrical side surface 420*a*, are formed on the cylindrical side surface 420*a* of the valve 420. The valve port 421 is deviated from the valve port 422 by about 90°.

A radiator port (radiator side inlet) 411 communicating with the radiator passage 210 and a bypass port (bypass side inlet) 412 communicating with the bypass passage 300 are formed on a part of the valve housing 410 which corresponds to the cylindrical side surface 420*a*. Further, a pump port (outlet) 413 for communicating the suction side of the pump 500 with a cylindrical inner portion 420*b* of the valve 420 is formed on a part of the valve housing 410 which corresponds to an axial end of the rotary shaft of the valve 420.

A packing 440 seals a gap between the cylindrical side surface 420*a* and the inner wall of the valve housing 410 to prevent the cooling water flowing into the valve housing 410 via the radiator port 411 and the bypass port 412 from bypassing the cylindrical inner portion 420 and flowing to the pump port 413.

As shown in FIG. 2A, a potentiometer 424 is provided on a rotary shaft 423 to detect a rotary angle of the valve 420, that is a valve opening degree of the flow control valve 400. Detected signals at the potentiometer 424 are input to ECU 600.

Electronic control unit (ECU) 600 controls the flow control valve 400 and the pump 500. Detected signals from a pressure sensor 610, a first, second and third water temperature sensors 621, 622 and 623 and a rotary sensor 624 are input to ECU 600. The pressure sensor 610 detects the manifold air pressure of the engine 100. The first through third water temperature sensors 621 to 623 detect the cooling water temperature. The rotary sensor 624 detects the engine speed of the engine 100. ECU 600 controls the flow control valve 400, the pump 500 and the blower 230 based on these detected signals.

The first water temperature sensor 621 detects a temperature of the cooling water flowing to the pump 500 at a side of the pump port 413 (hereinafter referred to as "the pump water temperature Tp").

The second water temperature sensor 622 detects a temperature of the cooling water passing through the bypass passage 300 at a side of the bypass port 412, that is a temperature of the cooling water flowing out from the engine 100 (hereinafter referred to as "the bypass water temperature Tb").

The third water temperature sensor 623 detects a temperature of the cooling water flowing out from the radiator 200 at a side of the radiator port 413 (hereinafter referred to as "the radiator water temperature Tr").

Figure 4:
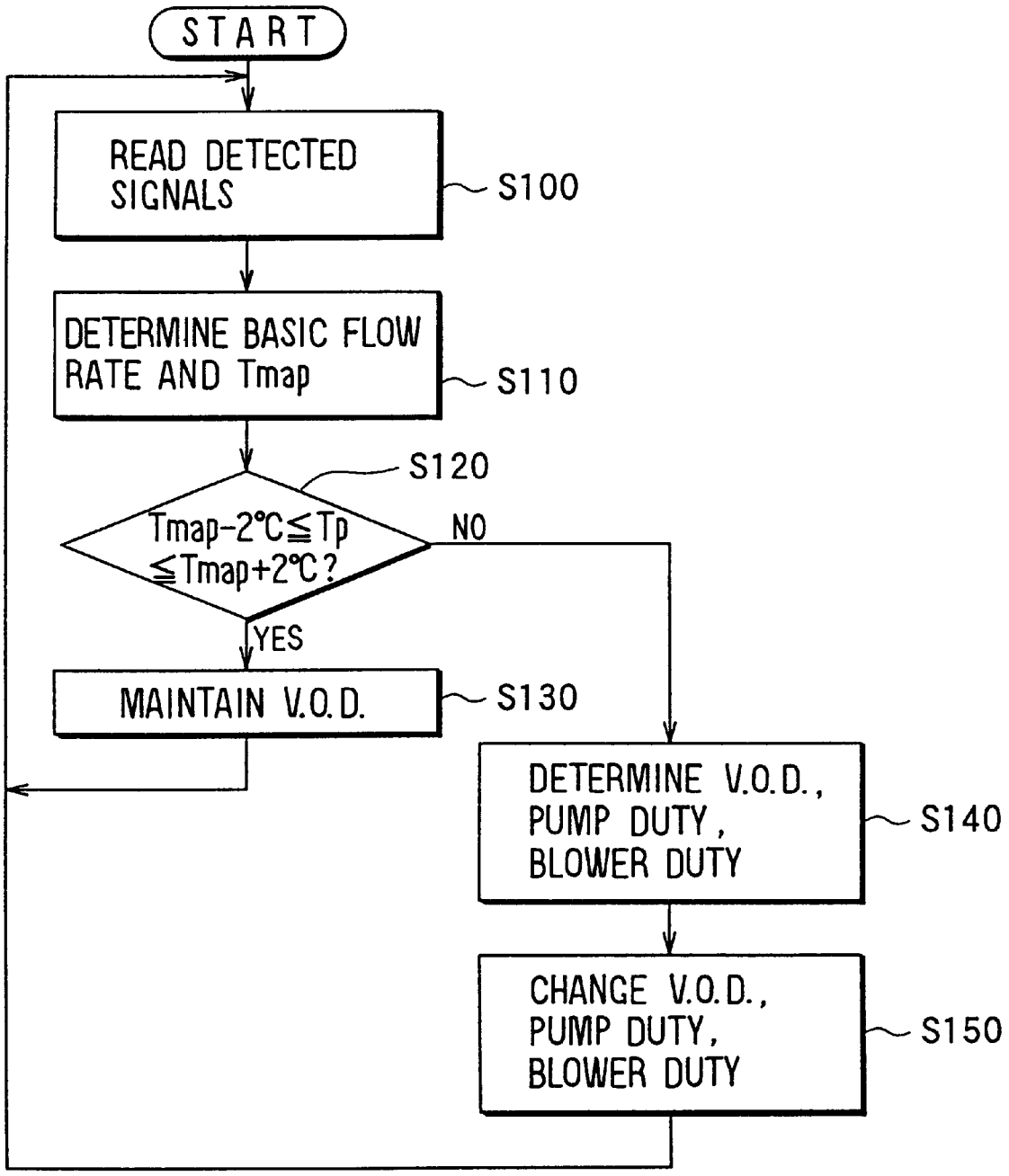
FIG. 4 is a flowchart showing operations of the cooling apparatus according to the embodiment of the present invention.

The operations of the embodiment will now be described according to a flowchart shown in FIG. 4.

When the engine 100 starts after turning on an ignition switch (not shown) of the vehicle, the detected signals of the respective sensors 610, 621, 622, 623 and 624 are input to ECU 600 in step S100.

In step S110, engine load is determined from the engine speed and the manifold air pressure of the engine 100, and a basic flow rate (rotation speed of the pump 500) of the cooling water which circulates in the engine 100 and a target temperature of the cooling water which flows in the engine 100 (hereinafter referred to as "the target water temperature Tmap") are determined from a map not shown.

The target water temperature Tmap is determined such that the water temperature under smaller engine load becomes higher than the water temperature under the greater engine load.

In step S120, it is determined whether the pump water temperature Tp is within a certain range including the target water temperature Tmap as a reference point. Specifically, it is determined whether the pump water temperature Tp is within the range between (Tmap−2° C.) and (Tmap+2° C.).

When the pump water temperature Tp is within the certain range, the current valve opening degree of the flow control valve 400 is maintained as it is in step S130, and returns to step S100.

When the pump water temperature Tp is out of the certain range, the step goes to step S140 to determine the valve opening degree to be changed from the current opening degree according to the maps shown in FIGS. 5 and 6, the flow rate to be changed from the current flow rate (the basic cooling water flow rate), and the blown air amount to be changed from the current blown air amount, based on the temperature difference ΔT (=Tmap−Tp). The valve opening degree, the cooling water flow rate and the blown air amount are determined such that the electric power consumption of the pump 500 and the blower 230 is minimized.

In FIG. 5, the rotation speed of the pump 500 increases as the duty of the pump 500 increases. In FIG. 6, the rotation speed of the blower 230 increases as the duty of the blower 230 increases. The duty of the pump 500 and the duty of the blower 230 are determined based on the engine load such that the electric power consumption of the pump 500 and the blower 230 is minimized.

In step S150, control signals are output to change the operational conditions of the flow control valve 400, pump 500 and blower 230. The flow control valve 400 is feedback controlled by repeating steps S100 through S150.

The pump water temperature Tp is determined by the mixture of the cooling water passing through the bypass passage 300 and the cooling water passing through the radiator 200. Therefore, the detection of the radiator flow rate Vr and the bypass flow rate Vb is necessary as well as the detection of the radiator water temperature Tr and the bypass water temperature Tb in order to match the pump water temperature Tp with the target water temperature Tmap accurately.

However, as described in the above, it is very difficult to measure the flow rate of the cooling water circulating in the cooling apparatus accurately.

According to the embodiment of the present invention, the radiator flow rate Vr and the bypass flow rate Vb, that is the valve opening degree, are determined based on the pump water temperature Tp, the radiator water temperature Tr and the bypass water temperature Tb as described as follows.

Since the pump water temperature Tp is determined by the mixture of the cooling water passing through the bypass passage 300 and the cooling water passing through the radiator 200, the pump water temperature Tp is represented by the following equation 1.

$$Tp=(Tr\cdot Vr+Tb\cdot Vb)/(Vr+Vb) \quad \text{[Equation 1]}$$

A ratio of the flow rate Vrb is defined by the following equation 2

$$Vrb=Vr/Vb \quad \text{[Equation 2]}$$

Accordingly, the equation 1 is converted to the following equation 3.

$$Tp=(Tb+Tr\cdot Vrb)/(1+Vrb) \quad \text{[Equation 3]}$$

Further, the equation 3 is converted to the following equation 4.

$$Vrb=(Tb-Tp)/(Tp-Tr) \quad \text{[Equation 4]}$$

Figure 7:
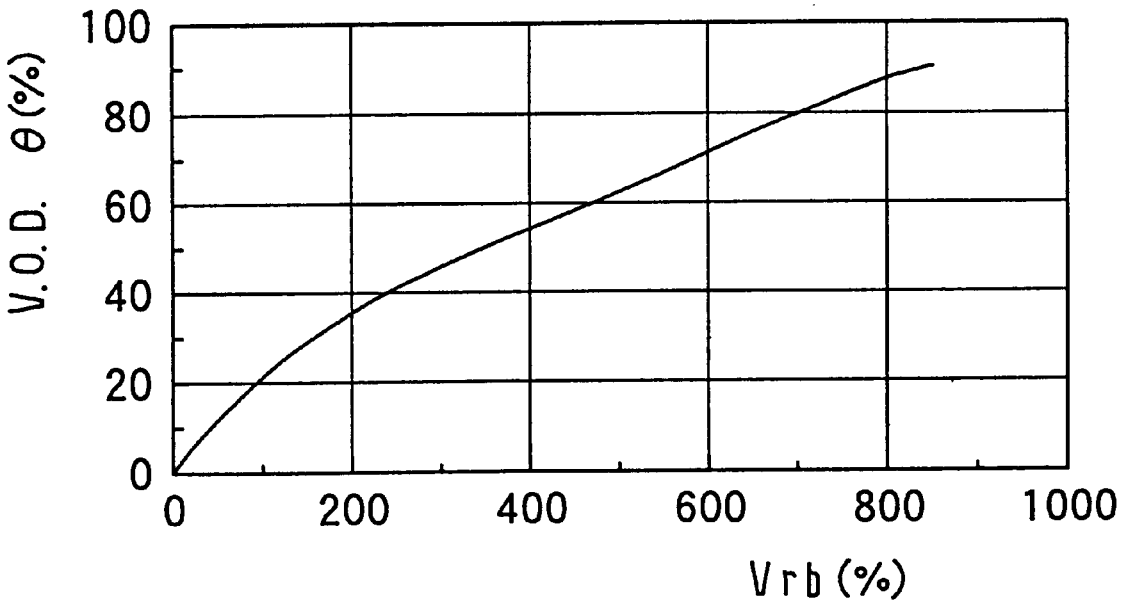
FIG. 7 is a graph showing a relation between the valve opening degree θ and the ratio of the flow rate Vrb according to the embodiment of the present invention.

The valve opening degree θ is determined as a function of Vrb as shown in FIG. 7. Thus, the valve opening degree is univocally determined from Vrb. It is to be noted that the relation between the valve opening degree θ and the flow rate ratio Vrb shown in FIG. 7 is derived from experimental data.

It is apparent from the equation 4, the flow rate ratio Vrb is calculated from the pump water temperature Tp, radiator water temperature Tr and the bypass water temperature Tb.

If the pump water temperature Tp in the equation 4 is substituted by the target water temperature Tmap, a target flow rate ratio Vrb is determined by equation 5 as follows.

$$Vrb=(Tb-Tmap)/(Tmap-Tr) \quad \text{[Equation 5]}$$

In this specification, the flow rate ratio Vrb determined by the equation 4 is called "the actual flow rate ratio Vrb", and the flow rate ratio Vrb determined by the equation 5 is called "the target flow rate ratio Vrb".

Accordingly, the target valve opening degree is determined by the target flow rate ratio Vrb and FIG. 7, and the actual valve opening degree is determined by the actual flow rate ratio Vrb and FIG. 7. The valve opening degree to be changed from the current valve opening degree (changing amount of the valve opening degree) shown in the map in FIG. 5 is determined from the difference between the target flow rate ratio Vrb and the actual flow rate ratio Vrb.

According to the embodiment of the present invention, the valve opening degree is accurately determined from the pump water temperature Tp, the radiator water temperature Tr and the bypass water temperature Tb, without measuring the actual cooling water flow rate.

Although the pump water temperature Tp is determined according to only the conditions of the cooling water passing through the bypass passage 300 and the cooling water passing through the radiator 200, there are time lags among the water temperature detection at the first through third water temperature sensors 621 through 623. Therefore, there may be a difference between the actual temperature and the detected temperature. Thus, it is desirable to place the first through third water temperature sensors 621 through 623 as close as possible.

When the engine load increases and the target water temperature Tmap decreases, the valve opening degree is changed and the radiator flow rate Vr increases. However, changing amount of the heat radiation performance of the radiator 100 against the changing amount of the radiator flow rate Vr (change ratio of the heat radiation performance) becomes smaller as the radiator flow rate Vr (flow speed in the radiator 200) becomes larger.

Even if the radiator flow rate Vr is increased in order to reduce the pump water temperature Tp, the heat radiation performance is not increased compared to the increased amount of the radiator flow rate Vr. Accordingly, the ratio of the cooling performance to the pump work of the pump 500 (the electric power consumption of the pump 500) necessary for circulating the cooling water to the radiator 200 is reduced, and unnecessary pump work increases.

According to the embodiment of the present invention, however, the blown air amount of the blower 230 is controlled based on the engine load. Thus, the heat radiation performance of the radiator 200 is increased when the blown air amount is increased according to the increase of the engine load. Accordingly, increase of the unnecessary pump work is prevented.

Figures 8A, 8B, 8C, 8D, 8E:
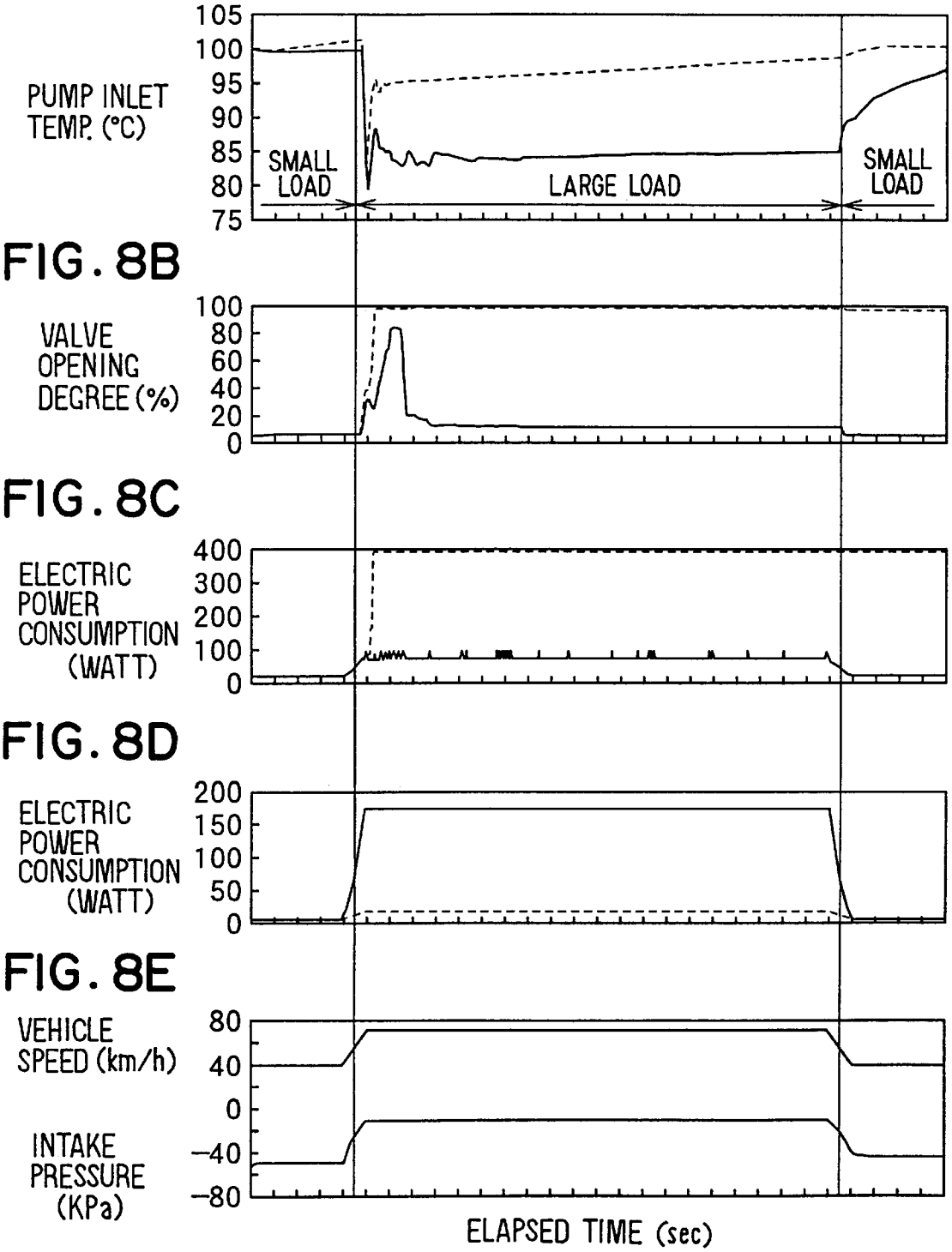
FIG. 8A is a graph showing a relation between the engine load and the water temperature at the inlet of the pump (the inlet temperature) according to the embodiment of the present invention.
FIG. 8B is a graph showing a relation between the engine load and the valve opening degree according to the embodiment of the present invention.
FIG. 8C is a graph showing a relation between the engine load and the electric power consumption of the pump according to the embodiment of the present invention.
FIG. 8D is a graph showing a relation between the engine load and the electric power consumption of the blower according to the embodiment of the present invention.
FIG. 8E is a graph showing a relation between the engine load and the vehicle speed and the intake pressure according to the embodiment of the present invention.

In FIG. 8A, the solid line represents the pump water temperature Tp when the blown air amount is increased according to the increase of the engine load, and the dotted line represents the pump water temperature Tp when the blown air amount is not increased according to the increase of the engine load.

It is apparent from FIGS. 8A and 8B that the electric power consumption of the pump water temperature Tp and the pump 500 is reduced when the blown air amount is increased according to the increase of the engine load even though the valve opening degree and the radiator flow rate Vr are smaller than those in the case when the blown air amount is not increased according to the increase of the engine load.

In general, flow speed of the traveling wind passing through the radiator 200 when a vehicle runs is comparably small, such as about 10% of the flow speed of the traveling wind. Accordingly, it is difficult to cool the cooling water only by the travelling wind when the vehicle speed is low and the engine load is large, such as at the slope to climb.

According to the embodiment of the present invention, however, the blown air amount at the blower 230 increases when the engine load is large. Accordingly, the cooling water temperature (the pump water temperature Tp) is certainly reduced when the engine load is large. Thus, the cooling water temperature is properly controlled according to the engine load.

In the embodiment of the present invention, three water temperature sensors 621, 622 and 623 are used to detect three kinds of water temperature, that is the pump water temperature Tp, the radiator water temperature Tr and the bypass water temperature Tb. However, it is possible to eliminate the second water temperature sensor 622 for detecting the bypass water temperature Tb, and the bypass water temperature Tb may be estimated from the pump water temperature Tp and the radiator water temperature Tr instead. One example of the estimation method for the ratio of the flow rate Vrb when the second water temperature sensor 622 is eliminated will now be described.

The bypass water temperature Tb is derived from the equation 4 as shown in the equation 6.

$$Tb=Tp+(Tp-Tr)\cdot Vrb \quad \text{[Equation 6]}$$

Since the ratio of the flow rate Vrb is univocally determined from the valve opening degree θ as shown in FIG. 7, the bypass water temperature Tb is estimated from a valve opening degree determined from a detected value of the potentiometer 424.

Since the maps shown in FIGS. 5 and 6 are determined for the atmospheric temperature of 25° C. in the above embodiment, it may be preferable to add a correction step between step S140 and step S150 for correcting the determined values determined in step S140.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A cooling apparatus for a liquid-cooled internal combustion engine using a coolant, comprising:

a radiator for cooling the coolant circulating between the liquid-cooled internal combustion engine and said radiator;

a bypass passage for introducing the flowing from the liquid-cooled internal combustion engine to an outlet side of said radiator directly to bypass said radiator;

a flow control valve having a bypass side inlet through which the coolant having passed through said bypass passage flows in, and a radiator side inlet through which the coolant having passed through said radiator flows in, and an outlet for discharging the coolant to the engine, for controlling a flow rate of the coolant passing through said bypass passage and the coolant passing through said radiator by changing an opening degree of said flow control valve; and control means for controlling the opening degree of said flow control valve, wherein said control means calculates an actual flow rate based on a first temperature of the coolant flowing out of said flow control valve, a second temperature of the coolant flowing through said bypass passage, and a third temperature of the coolant flowing out of said radiator;

said control means calculates a target flow rate based on a target coolant temperature, the second temperature of the coolant flowing through said bypass passage, and the third temperature of the coolant flowing out of said radiator; and said control means controls the opening degree of said flow control valve based on the actual flow rate and the target flow rate.

2. A cooling apparatus according to claim 1, wherein said opening degree of said flow control valve is feedback controlled based on said first, second and third temperatures such that said first temperature conforms with the target coolant temperature determined based on an engine load of the engine.

3. A cooling apparatus according to claim 2, wherein;

said cooling apparatus includes a blower for generating air flow passing through said radiator; and blown air amount of said blower is controlled based on the engine load of the engine.

4. A cooling apparatus according to claim 2, wherein;

said cooling apparatus includes a pump which is driven independently of the engine for circulating the coolant; and discharging flow rate of said pump is controlled based on the engine load of the engine.

5. A cooling apparatus according to claim 1, wherein;

said cooling apparatus includes a blower for generating air flow passing through said radiator; and blown air amount of said blower is controlled based on an engine load of the engine.

6. A cooling apparatus according to claim 5, wherein;

said cooling apparatus includes a pump which is driven independently of the engine for circulating the coolant; and discharging flow rate of said pump is controlled based on the engine load of the engine.

7. A cooling apparatus according to claim 6, wherein the opening degree of said flow control valve is controlled in such a manner that electric consumption of said pump and blower is minimized.

8. A cooling apparatus according to claim 5, wherein the blown air amount of said blower is controlled in a stepwise manner based on the engine load of the engine.

9. A cooling apparatus according to claim 1, wherein;

said cooling apparatus includes a pump which is driven independently of the engine for circulating the coolant; and discharging flow rate of said pump is controlled based on an engine load of the engine.

10. A cooling apparatus for a liquid-cooled internal combustion engine using a coolant, comprising:

a radiator for cooling the coolant circulating between the liquid-cooled internal combustion engine and said radiator;

a bypass passage for introducing the flowing from the liquid-cooled internal combustion engine to an outlet side of said radiator directly to bypass said radiator;

a flow control valve for controlling a flow rate of the coolant passing through said bypass passage and the coolant passing through said radiator by changing an opening degree of said flow control valve; and control means for controlling the opening degree of said flow control valve; wherein:

said control means calculates an actual flow rate based on a first temperature of the coolant flowing out of said flow control valve, a second temperature of the coolant flowing flowing through said bypass passage, and a third temperature of the coolant flowing out of said radiator;

the first temperature is determined by the mixture of the coolant flowing through said bypass passage and the coolant flowing through said radiator;

said control means calculates a target flow rate based on a target coolant temperature, the second temperature of the coolant flowing through said bypass passage, and the third temperature of the coolant flowing out of said radiator; and said control means controls the opening degreee of said flow control valve based on the actual flow rate and the target flow rate.

* * * * *